US009841185B2

(12) United States Patent
Beveridge

(10) Patent No.: US 9,841,185 B2
(45) Date of Patent: Dec. 12, 2017

(54) STEAM TEMPERATURE CONTROL USING MODEL-BASED TEMPERATURE BALANCING

(71) Applicant: EMERSON PROCESS MANAGEMENT POWER & WATER SOLUTIONS, INC., Pittsburgh, PA (US)

(72) Inventor: Robert Allen Beveridge, New Kensington, PA (US)

(73) Assignee: EMERSON PROCESS MANAGEMENT POWER & WATER SOLUTIONS, INC., Pittsburgh, PA (US)

( * ) Notice: Subject to any disclaimer, the term of this patent is extended or adjusted under 35 U.S.C. 154(b) by 484 days.

(21) Appl. No.: 14/066,186

(22) Filed: Oct. 29, 2013

(65) Prior Publication Data

US 2015/0114320 A1 Apr. 30, 2015

(51) Int. Cl.
*F22G 5/12* (2006.01)
*F22G 5/00* (2006.01)
(Continued)

(52) U.S. Cl.
CPC ..... *F22G 5/123* (2013.01); *F01K 13/02* (2013.01); *F22G 5/00* (2013.01); *F22G 5/12* (2013.01); *F22G 5/20* (2013.01)

(58) Field of Classification Search
CPC ... F22G 5/12; F22G 5/123; F22G 5/20; F22G 5/10; F22G 5/126; F22G 5/14; F22G 5/16; F22G 5/18; F22G 5/00
(Continued)

(56) References Cited

U.S. PATENT DOCUMENTS 3,151,601 A * 10/1964 Mumper ..... F22B 31/04 122/479.4
3,175,542 A * 3/1965 Bachl ..... F22G 7/14 122/1 R
(Continued)

FOREIGN PATENT DOCUMENTS

DE EP 0195298 A1 * 9/1986 ..... F22B 35/108
DE 229 767 A1 11/1986
JP 2004-116953 A 4/2004

OTHER PUBLICATIONS

Search Report for Application No. GB1418409.7, dated Apr. 17, 2015.

*Primary Examiner* — Steven B McAllister
*Assistant Examiner* — Steven Anderson, II
(74) *Attorney, Agent, or Firm* — Marshall, Gerstein & Borun LLP

(57) ABSTRACT

A technique of controlling a steam generating boiler system having multiple superheater sections includes determining multiple control signals to control a temperature of output steam to a turbine. The technique uses a first control block to determine an offset value based on multiple input temperatures and a dynamic matrix control (DMC) block to determine input steam control signals based on an output temperature and an output temperature setpoint. The technique modifies one of the input steam control signals based on the offset value. The modified input steam control signal and the unmodified input steam control signal are provided to respective field devices to control the input temperatures and, as a result, the output temperature.

30 Claims, 4 Drawing Sheets

(51) Int. Cl.
*F22G 5/20* (2006.01)
*F01K 13/02* (2006.01)

(58) Field of Classification Search
USPC ..... 122/479.1
See application file for complete search history.

(56) References Cited

U.S. PATENT DOCUMENTS

| | | | | | |
|---|---|---|---|---|---|
| 3,205,870 | A * | 9/1965 | Durham | F22G 5/04 | 122/479.5 |
| 3,306,235 | A * | 2/1967 | Lewis | C23F 15/00 | 106/14.21 |
| 3,627,062 | A * | 12/1971 | Jenkins, Jr. | F22G 5/20 | 122/479.1 |
| 4,296,730 | A * | 10/1981 | Zadiraka | F22G 5/12 | 122/479.1 |
| 2006/0004470 | A1 | 1/2006 | Lietzau | | |
| 2010/0077970 | A1* | 4/2010 | Kumar | F22G 5/12 | 122/479.1 |
| 2012/0036852 | A1* | 2/2012 | Beveridge | F22G 5/12 | 60/653 |

* cited by examiner

STEAM TEMPERATURE CONTROL USING MODEL-BASED TEMPERATURE BALANCING

TECHNICAL FIELD

This patent relates generally to the control of boiler systems and in one particular instance to the control and optimization of steam generating boiler systems using model-based temperature balancing.

BACKGROUND

A variety of industrial as well as non-industrial applications use fuel burning boilers which typically operate to convert chemical energy into thermal energy by burning one of various types of fuels, such as coal, gas, oil, waste material, etc. An exemplary use of fuel burning boilers is in thermal power generators, wherein fuel burning boilers generate steam from water traveling through a number of pipes and tubes within the boiler, and the generated steam is then used to operate one or more steam turbines to generate electricity. The output of a thermal power generator is a function of the amount of heat generated in a boiler, wherein the amount of heat is directly determined by the amount of fuel consumed (e.g., burned) per hour, for example.

In many cases, power generating systems include a boiler which has a furnace that burns or otherwise uses fuel to generate heat which, in turn, is transferred to water flowing through pipes or tubes within various sections of the boiler. A typical steam generating system includes a boiler having a superheater section (having one or more sub-sections) in which steam is produced and is then provided to and used within a first, typically high pressure, steam turbine. While the efficiency of a thermal-based power generator is heavily dependent upon the heat transfer efficiency of the particular furnace/boiler combination used to burn the fuel and transfer the heat to the water flowing within the superheater section or any additional section(s) of the boiler, this efficiency is also dependent on the control technique used to control the temperature of the steam in the superheater section or any additional section (s) of the boiler.

However, as will be understood, the steam turbines of a power plant are typically run at different operating levels at different times to produce different amounts of electricity based on energy or load demands. For most power plants using steam boilers, the desired steam temperature setpoints at final superheater outlets of the boilers are kept constant, and it is necessary to maintain steam temperature close to the setpoints (e.g., within a narrow range) at all load levels. In particular, in the operation of utility (e.g., power generation) boilers, control of steam temperature is critical as it is important that the temperature of steam exiting from a boiler and entering a steam turbine is at an optimally desired temperature. If the steam temperature is too high, the steam may cause damage to the blades of the steam turbine for various metallurgical reasons. On the other hand, if the steam temperature is too low, the steam may contain water particles, which in turn may cause damage to components of the steam turbine over prolonged operation of the steam turbine as well as decrease efficiency of the operation of the turbine. Moreover, variations in steam temperature also cause metal material fatigue, which is a leading cause of tube leaks.

Typically, each section (i.e., the superheater section and any additional sections such as a reheater section) of the boiler contains cascaded heat exchanger sections wherein the steam exiting from one heat exchanger section enters the following heat exchanger section with the temperature of the steam increasing at each heat exchanger section until, ideally, the steam is output to the turbine at the desired steam temperature. For example, some heat exchanger sections include individual primary superheaters that are connected in parallel, and which may in turn be connected in series to a final superheater. In such cascaded arrangements, steam temperature is controlled primarily by controlling the temperature of the water at the output of the first stage of the boiler which is primarily achieved by changing the fuel/air mixture provided to the furnace or by changing the ratio of firing rate to input feedwater provided to the furnace/boiler combination. In once-through boiler systems, in which no drum is used, the firing rate to feedwater ratio input to the system may be used primarily to regulate the steam temperature at the input of the turbines.

While changing the fuel/air ratio and the firing rate to feedwater ratio provided to the furnace/boiler combination operates well to achieve desired control of the steam temperature over time, it is difficult to control short term fluctuations in steam temperature at the various sections of the boiler using only fuel/air mixture control and firing rate to feedwater ratio control. Instead, to perform short term (and secondary) control of steam temperature, saturated water is sprayed into the steam at a point before the final heat exchanger section located immediately upstream of the turbine. This secondary steam temperature control operation typically occurs at the output of each primary superheater and before the final superheater section of the boiler. To effect this operation, temperature sensors are provided along the steam flow path and between the heat exchanger sections to measure the steam temperature at critical points along the flow path, and the measured temperatures are used to regulate the amount of saturated water sprayed into the steam for steam temperature control purposes.

In many circumstances, it is necessary to rely heavily on the spray technique to control the steam temperature as precisely as needed to satisfy the turbine temperature constraints described above. In one example, once-through boiler systems, which provide a continuous flow of water (steam) through a set of pipes within the boiler and do not use a drum to, in effect, average out the temperature of the steam or water exiting the first boiler section, may experience greater fluctuations in steam temperature and thus typically require heavier use of the spray sections to control the steam temperature at the inputs to the turbines. In these systems, the firing rate to feedwater ratio control is typically used, along with superheater spray flow, to regulate the furnace/boiler system. In these and other boiler systems, a distributed control system (DCS) uses cascaded PID (Proportional Integral Derivative) controllers to control both the fuel/air mixture provided to the furnace as well as the amount of spraying performed upstream of the turbines.

However, cascaded PID controllers typically respond in a reactionary manner to a difference or error between a setpoint and an actual value or level of a dependent process variable to be controlled, such as a temperature of steam to be delivered to the turbine. That is, the control response occurs after the dependent process variable has already drifted from its set point. For example, spray valves that are upstream of a turbine are controlled to readjust their spray flow only after the temperature of the steam delivered to the turbine has drifted from its desired target. Needless to say, this reactionary control response coupled with changing boiler operating conditions can result in large temperature swings that cause stress on the boiler system and shorten the lives of tubes, spray control valves, and other components of the system.

SUMMARY

Embodiments of systems, methods, and controllers as described herein include a technique of controlling a steam generating system include using dynamic matrix control to control at least a portion of the steam generating system, such as a temperature of steam input into a final superheater component of the steam generating system. The final superheater component heats the input steam to produce output steam that is input to a turbine. As used herein, the term "output steam" refers to the steam delivered from the steam generating system immediately into a turbine. An "output steam temperature," as used herein, is a temperature of the output steam that is exiting the steam generating system and entering into the turbine.

The technique of controlling a steam generating system may include a first control block that receives, as inputs, two signals each corresponding to an actual value, level, or measurement of an intermediate portion of the steam generating system. The technique further includes a dynamic matrix control block that receives, as its inputs, a signal corresponding to an actual value, level, or measurement of the portion of the steam generating system that is to be controlled (e.g., the actual output steam temperature); and a setpoint of the portion of the steam generating system that is to be controlled (e.g., the output steam temperature setpoint). The first control block generates, based on its inputs, an offset value that represents a difference between the actual value, level, or measurement of the two input signals. The dynamic matrix control block generates, based on its inputs, a control signal associated with multiple field devices to control the values, levels, or measurements of the intermediate portion. The technique further includes a module to generate, from the control signal of the dynamic matrix control, a first control signal and a second control signal. An additional module modifies the first control signal based on the offset value. The technique is configured to provide the modified first control signal to a first field device to control a section of the intermediate portion and provide the second control signal to a second field device to control an additional section of the intermediate portion. The first field device and the second field device influence the at least a portion of the steam generating system towards its desired output steam temperature setpoint. Accordingly, life spans of tubes, valves, and other internal components of the steam generating system are prolonged as the technique minimizes stress due to swings of temperature and other variables in the system.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention as describing every possible embodiment would be impractical, if not impossible. Numerous alternative embodiments could be implemented, using either current technology or technology developed after the filing date of this patent, which would still fall within the scope of the claims defining the invention.

Figure 1:
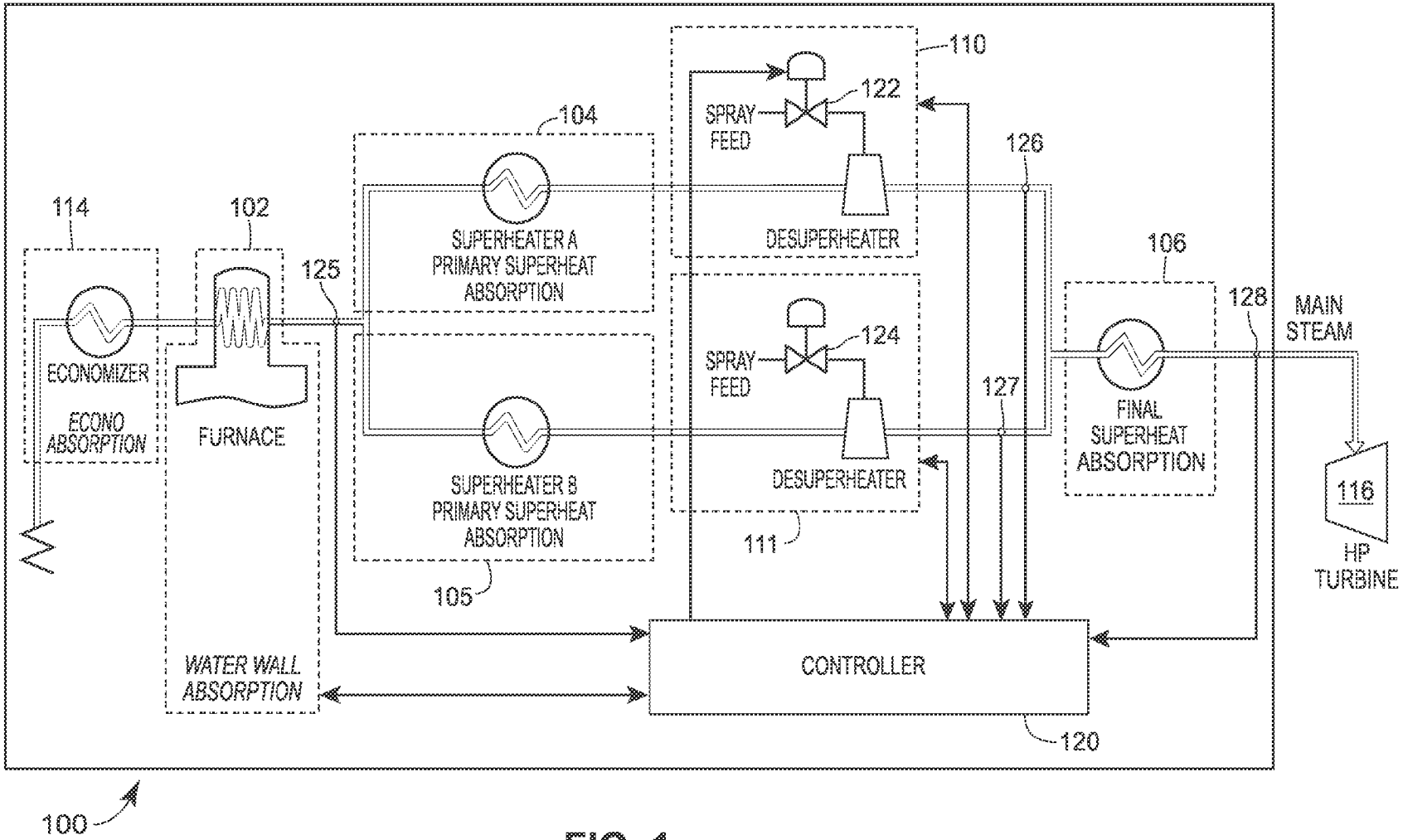
FIG. 1 illustrates a block diagram of a typical boiler steam cycle having a superheater section for a typical set of steam powered turbines, the superheater section having two primary superheaters connected in parallel to a final superheater.

FIG. 1 illustrates a block diagram of a once-through boiler steam cycle for a typical boiler 100 that may be used, for example, in a thermal power plant. The boiler 100 may include various sections through which steam or water flows in various forms. The boiler 100 of FIG. 1 depicts multiple superheater sections through which superheated steam flows, although it should be appreciated that other sections such as a reheater section are envisioned. While the boiler 100 illustrated in FIG. 1 has various boiler sections situated horizontally, in an actual implementation, one or more of these sections may be positioned vertically with respect to one another, especially because flue gases heating the steam in various different boiler sections, such as a water wall absorption section, rise vertically (or, spiral vertically).

In any event, as illustrated in FIG. 1, the boiler 100 includes a furnace and a primary water wall absorption section 102, a first primary superheater absorption section 104, a second primary superheater absorption section 105, and a final superheater absorption section 106. Additionally, the boiler 100 may include a first desuperheater or sprayer section 110, a second desuperheater section or sprayer section 111, and an economizer section 114. During operation, the main steam generated by the boiler 100 and output by the final superheater absorption section 106 is used to drive a high pressure (HP) turbine 116. In some cases, the boiler 100 may also be used to drive a low or intermediate pressure turbine, such as one included in a reheater absorption section, which is not illustrated in FIG. 1.

The water wall absorption section 102, which is primarily responsible for generating steam, includes a number of pipes through which water or steam from the economizer section 114 is heated in the furnace. Of course, feedwater coming into the water wall absorption section 102 may be pumped through the economizer section 114 and this water absorbs a large amount of heat when in the water wall absorption section 102. The steam or water provided at output of the water wall absorption section 102 is fed to both the first primary superheater absorption section 104 and the second primary superheater absorption section 105.

As illustrated in FIG. 1, the first primary superheater absorption section 104 is connected in parallel with the second primary superheater absorption section 105 (i.e., water flows concurrently through the first primary superheater absorption section 104 and the second primary superheater absorption section 105). Each of the first primary superheater absorption section 104 and the second primary superheater absorption section 105 is configured to heat water entering therein and to output the heated water. Water exiting from both the first primary superheater absorption section 104 and the second primary superheater absorption section 105 is fed to the final superheater absorption section 106. In particular, water from the first primary superheater absorption section 104 is combined with water from the second primary superheater absorption section 105 before being fed to the final superheater absorption section 106. The use of the first primary superheater absorption section 104, the second primary superheater absorption section 105, and the final superheater absorption section 106 together raise the steam temperature to very high levels. The main steam output from the final superheater absorption section 106 drives the high pressure turbine 116 to generate electricity.

The first sprayer section 110 and the second sprayer section 111 may be used to control the respective temperatures of the steam output from the first primary superheater absorption section 104 and the second primary superheater absorption section 105, and therefore to control the temperature of the steam input into the final superheater absorption section 106 as well as, to a lesser degree, the final steam temperature at the input of the turbine 116. Accordingly, the first sprayer section 110 and the second sprayer section 111 may be controlled to adjust the final steam temperature at the input of the turbine 116 to be at a desired setpoint. For each of the first sprayer section 110 and the second sprayer section 111, a spray feed may be used as a source of water (or other liquid) that is supplied to a valve (as illustrated: valves 122 and 124) used to control an amount of spray that is applied to the output steam from the respective sprayer section 110 or 111 and therefore used to adjust the temperature of the output steam. Generally, the more spray that is used (i.e., the more that the valve 122 or 124 is opened), the more the output steam from the respective sprayer section 110 or 111 is cooled or reduced in temperature. In some cases, the spray feed provided to the sprayer sections 110 and 111 can be tapped from the feed line into the economizer section 114.

It should be appreciated that the steam from the turbine 116 may be routed to a reheater absorption section (not illustrated in FIG. 1), and the hot reheated steam that is output from the reheater absorption section can be fed through one or more additional turbine systems (not illustrated in FIG. 1), and/or to a steam condenser (not illustrated in FIG. 1) where the steam is condensed to a liquid form, and the cycle begins again with various boiler feed pumps pumping the feedwater through a cascade of feedwater heater trains and then to the economizer section 114 for the next cycle. The economizer section 114 is located in the flow of hot exhaust gases exiting from the boiler 100 and uses the hot gases to transfer additional heat to the feedwater before the feedwater enters the water wall absorption section 102.

As illustrated in FIG. 1, a controller or controller unit 120 is communicatively coupled to the furnace within the water wall section 102 and to the valves 122 and 124 which respectively control the amount of water provided to sprayers in the first sprayer section 110 and the second sprayer section 111. The controller 120 can also be communicatively coupled to flow sensors (not shown in FIG. 1) at the outputs of the valves 122, 124. The controller 120 is also coupled to various sensors, including an intermediate temperature sensor 125 located at the output of the water wall absorption section 102, multiple primary temperature sensors 126, 127 respectively located at the outputs of the first sprayer section 110 and the second sprayer section 111; and an output temperature sensor 128 located at the output of the final superheater absorption section 106. The controller 120 also receives other inputs including the firing rate, a load signal (typically referred to as a feed forward signal) which is indicative of and/or a derivative of an actual or desired load of the power plant, as well as signals indicative of settings or features of the boiler including, for example, damper settings, burner tilt positions, etc. The controller 120 may generate and send other control signals to the various boiler and furnace sections of the system and may receive other measurements, such as valve positions, measured spray flows, other temperature measurements, etc. While not specifically illustrated as such in FIG. 1, the controller or controller unit 120 could include separate sections, routines and/or control devices for controlling the superheater section and the optional reheater section of the boiler system.

Figure 2:
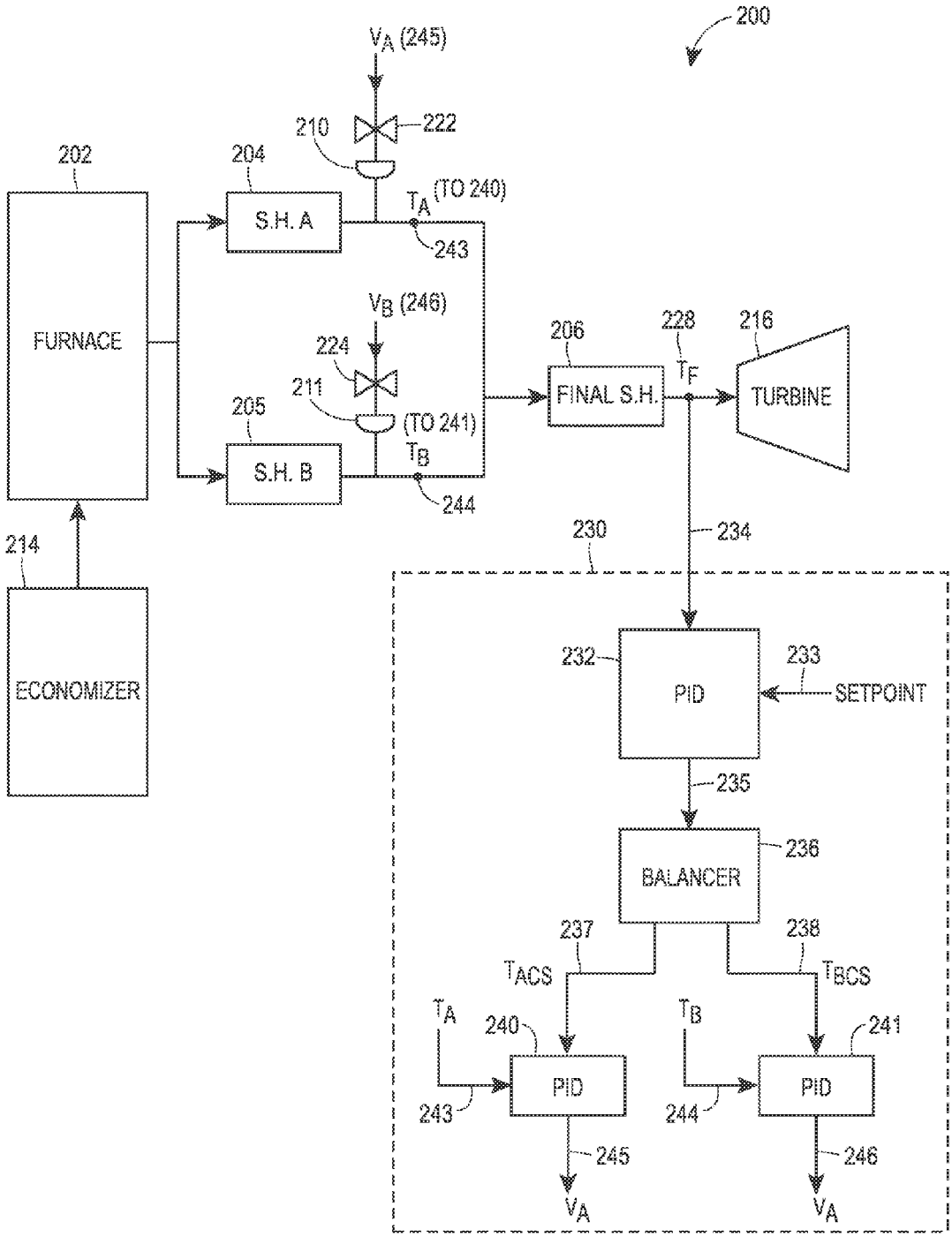
FIG. 2 (PRIOR ART)
FIG. 2 illustrates a schematic diagram of a prior art manner of controlling a superheater section of a boiler steam cycle for a steam powered turbine, such as that of FIG. 1.

FIG. 2 is a schematic diagram 200 showing the various sections of the boiler system 100 of FIG. 1 and illustrating a typical manner in which control is currently performed in various boilers of this type in the prior art. In particular, the diagram 200 illustrates an economizer 214, a primary furnace or water wall section 202, a superheater section A 204, a superheater section B 205, a first sprayer section 210 coupled to the superheater section A 204, and a second sprayer section 211 coupled to the superheater section B 205. The superheater section A 204 is connected in parallel with the superheater section B 205, with each having outputs connecting to a final superheater section 206. FIG. 2 also illustrates a cascaded proportional-integral-derivative (PID) based control loop 230 which may be implemented by the controller 120 of FIG. 1 or by one or more other DCS controllers to control the fuel and feedwater operation of the furnace 202 to affect (i.e., control) a temperature 228 of steam output from the final superheater section 206 and delivered by the boiler system to a turbine 216 to be at a setpoint.

In particular, the control loop 230 includes a first control block 232, illustrated in the form of a PID control block, which uses, as primary inputs, a setpoint 233 in the form of a factor or signal corresponding to a desired or optimal value of a control variable and an actual or measured temperature value 234 of the boiler system. As illustrated in FIG. 2, the actual parameter value 234 may correspond to the output steam temperature 228 (i.e., the temperature of the steam output from the final superheater section 206) whereby the actual parameter value 234 may be the actual or measured output steam temperature 228 or a value based thereon. Further, the setpoint 233 may correspond to, for example, a desired temperature for the steam output from the final superheater section 206 or a value based thereon. In other cases, the setpoint 233 may correspond to other conditions that may influence the output steam temperature 228, such as a damper position of a damper within the boiler system, a position of a spray valve, an amount of spray, some other control, manipulated or disturbance variable or combination thereof that is used to control or is associated with one or more sections of the boiler system. Generally, the setpoint 233 may correspond to a control variable or a manipulated variable of the boiler system, and may be typically set by a user or an operator.

The first control block 232 can compare the setpoint 233 to a measure of the actual parameter value 234 to produce a desired output value. For clarity of discussion, FIG. 2 illustrates a situation in which the setpoint 233 at the first control block 232 corresponds to a desired output steam temperature. The control block 232 compares the output steam temperature setpoint 233 to the actual parameter value 234 (i.e., a measure of the actual temperature 228 of the steam currently being output from the final superheater section 206), to produce an output temperature signal 235. The output temperature signal 235 is indicative of a setting or position for one or more field devices to influence the steam output from the final superheater section 206 to achieve the desired temperature setpoint 233.

Typically, the output temperature signal 235 is used to determine respective settings or positions for the first sprayer section 210 and the second sprayer section 220 (i.e., valve positions associated with controlling sprayers at the first sprayer section 210 and the second sprayer section 220). In particular, the output temperature signal 235 is provided to a balancer module 236 of the control loop 230 which can process the output temperature signal 235 to generate, determine, or calculate a temperature A value 237 and a temperature B value 238. The balancer module 236 generally operates to generate the values 237, 238 such that the values 237, 238 are equivalent (i.e., balanced). The temperature A value 237 can be indicative of a desired value for a temperature A 243 of steam output from the superheater section A 204 and the temperature B value 238 can be indicative of a desired value for a temperature B 244 of steam output from the superheater section B 205.

The control loop 230 as illustrated in FIG. 2 further includes a second control block 240 and a third control block 241, both illustrated in the form of PID control blocks. The second control block 240 uses, as primary inputs, the temperature A value 237 that is output by the balancer module 236 and the actual temperature A 243 of steam output from the superheater section A 204. The third control block 241 uses, as primary inputs, the temperature B value 238 that is output by the balancer module 236 and the actual temperature B 244 of steam output from the superheater section B 205. The second control block 240 compares the temperature A value 237 to the actual temperature A 243 to produce a desired valve A control signal 245, and the third control block 241 compares the temperature B value 238 to the actual temperature B 244 to produce a desired valve B control signal 246. The valve A control signal 245 drives a valve 222 that controls the first sprayer section 210 to a desired valve position, and therefore to adjust the amount of water sprayed on the steam output from the superheater section A 204, and to adjust the temperature A 243 from the current temperature A 243 closer to the temperature A value 237. Similarly, the valve B control signal 246 drives a valve 224 that controls the second sprayer section 211 to a desired valve position, and therefore to adjust the amount of water sprayed on the steam output from the superheater section B 205, and to adjust the temperature B 244 from the current temperature B 244 closer to the temperature B value 238.

However, the control loop 230 as it exists in current process control systems has some drawbacks. In particular, the valve control signals 245, 246 are determined based on current conditions within the boiler system 100, versus predicted or modeled conditions that are determined to result from various modifications. As a result, the valve control signals 245, 246 output using the three PID control blocks 232, 240, 241 may result in a situation in which the output steam temperature 228 may never reach its setpoint 233. In other situations, an oscillating effect may result whereby valves A and B (222, 224) are adjusted too frequently as a result of the respective temperatures A and B 243, 244 oscillating above and below the respective temperature A and B values 237, 238. Accordingly, the control system as depicted in FIG. 2 may experience a large amount of fluctuation and general overuse.

Figure 3:
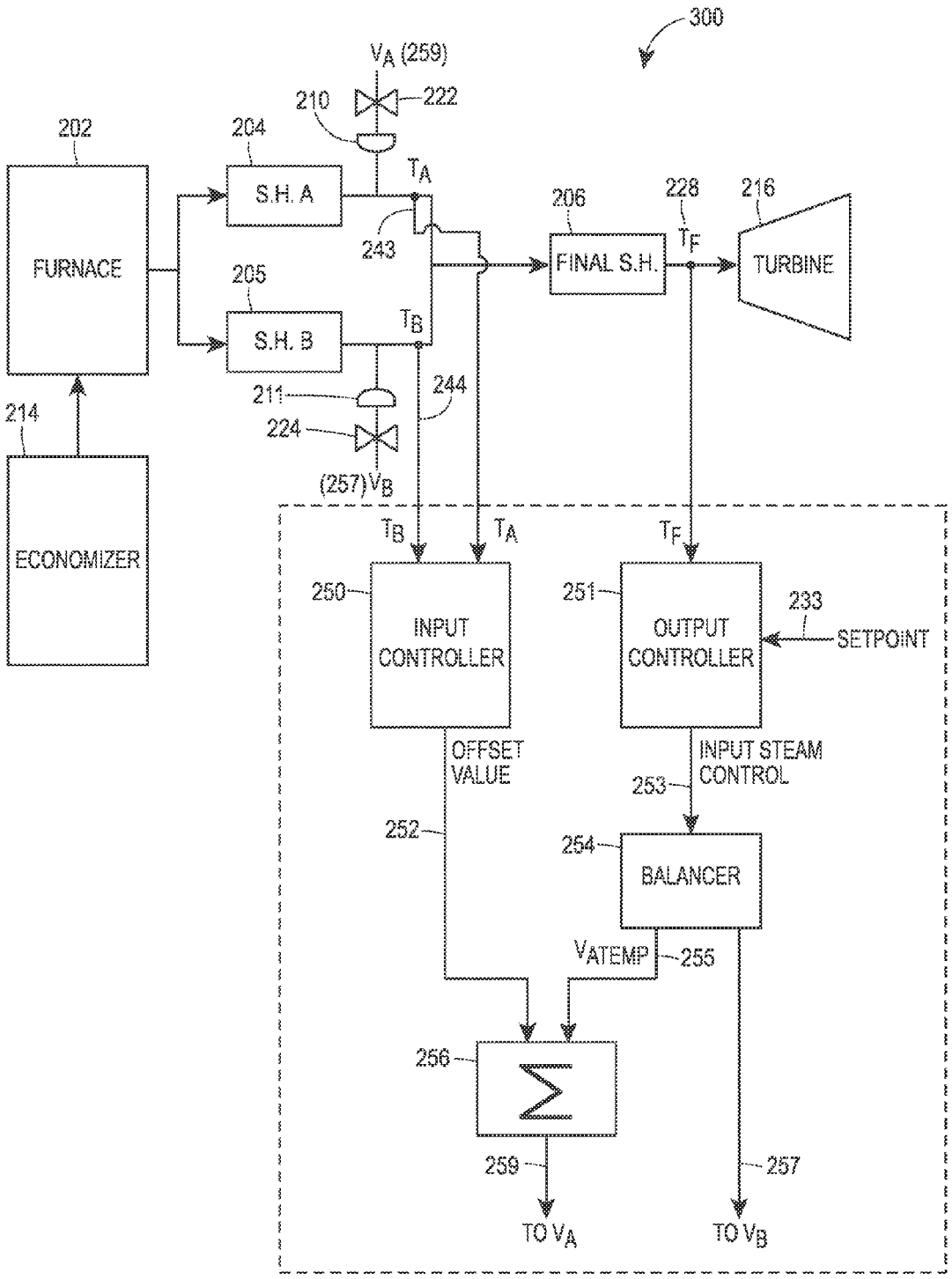
FIG. 3 illustrates a schematic diagram of a manner of controlling the boiler steam cycle of the superheater section of FIG. 1 in a manner which helps to optimize efficiency of the system.

FIG. 3 illustrates a control system or control scheme 300 for controlling the steam generating boiler system 100. The control system 300 may control at least a portion of the boiler system 100 such as one or more control variables or other dependent process variable(s) of the boiler system 100. In the example illustrated in FIG. 3, the control system 300 controls the output steam temperature 228, but it should be appreciated that the control system 300 may control another portion of the boiler system 100 (e.g., a system output, an output parameter, or an output control variable such as a pressure of the output steam at the turbine 118). In particular, the control system 300 controls a valve A control signal 259 and a valve B control signal 257 that control respective valve-sprayer component pairs (210, 222 and 211, 224) that supply water to steam respectively output from superheater section A 204 and superheater section B 205. Further, as illustrated in FIG. 3, the superheater section A 204 is connected in parallel with the superheater section B 205, which are both connected to the final superheater section 206 which outputs steam having the output steam temperature 228.

The control system 300 may be performed in or may be communicatively coupled with the controller or controller unit 120 of the boiler system 100. For example, at least a portion of the control system 300 may be included in the controller 120. In other implementations, the entire control system 300 may be included in the controller 120.

The components of the control system 300 can reduce the plateauing and/or oscillating effect experienced in PID-based control loop 230 as discussed with respect to FIG. 2. Indeed, the control system 300 of FIG. 3 may be a replacement for the PID-based control loop 230 of FIG. 2. Instead of being reactionary like the control loop 230 (e.g., where a control adjustment is not initiated until after a difference or error is detected between the portion of the boiler system 100 that is desired to be controlled and a corresponding setpoint), the control system 300 is at least partially feed forward in nature, so that the control adjustment can be initiated before a difference or error at the portion of the boiler system 100 is detected.

As illustrated in FIG. 3, the furnace 202 generates steam and provides, in parallel, the steam to superheater section A 204 for heating and to superheater section B 205 for heating. It should be appreciated that multiple furnaces can respectively provide steam to superheater section A 204 and superheater section B 205. Valve A 222 can control the first sprayer section 210 to control the amount of water supplied to the steam output from superheater section A 204, and therefore control the temperature (243) of the steam output from superheater section A 204. Valve B 224 can control the second sprayer section 211 to control the amount of water supplied to the steam output from superheater section B 205, and therefore control the temperature (244) of the steam output from superheater section B 205. The output steam (after any cooling by the respective sprayer sections 210, 211) from superheater section A 204 and superheater section B 205 is combined and provided as input steam to the final superheater section 206, whereby the final superheater section 206 is configured to heat the combined output steam. The output steam from the final superheater section 206 can be provided to the turbine 216 to generate electricity.

As illustrated in FIG. 3, a control loop 330 of the control system 300 includes an input controller 250 and an output controller 251. The input controller 250 can be a PID-based controller or a dynamic matrix controller (DMC), and the output controller 251 can be a DMC. The input controller 250 can receive, as inputs, temperature A 243 (or a control value associated with temperature A 243) of the steam output from superheater section A 204 and temperature B 244 (or a control value associated with temperature B 244)

of the steam output from superheater section B 205, after any cooling by the respective sprayer sections 210, 211.

Generally, as the number of inputs for a DMC-based output controller (such as the output controller 251) increases, the model used to program that output controller increases exponentially due to the number of potential input combinations for which to account. To reduce the complexity of the model of the output controller 251, the output controller 251 and its model thereof account for a single temperature value that corresponds to both temperature A 243 and temperature B 244. In particular, the single temperature value represents an equal temperature value for both temperature A 243 and temperature B 244 (i.e., the output controller 251 "assumes" that temperature A 243 is equal to temperature B 244). Therefore, the model is significantly less complex that what would be required if the model was to account for the input combinations of both temperature A 243 and temperature B 244.

In order to ensure that temperature A 243 is equal to temperature B 244, the control loop 330 includes the input controller 250 to calculate a temperature difference or offset used to facilitate the equal values of temperature A 243 and temperature B 244. Because the input controller 250 simply operates based on the difference or offset between temperature A 243 and temperature B 244, the programming of the input controller 250 need not be complex, and certainly not as complex as programming the model-based output controller 251 to account for both temperature A 243 and temperature B 244. The combination of the input controller 250 and the output controller 251 therefore enables the control loop 330 to effectively and efficiently control both temperature A 243 and temperature B 244 without the complex programming required by model-based controllers that account for multiple parameters.

Referring to FIG. 3, the input controller 250 can determine an offset value output 252 based on temperature A 243 and temperature B 244. In some cases, the offset value output 252 can reflect a difference between temperature A 243 and temperature B 244. For example, if temperature A 243 is 200° F. and temperature B 244 is 215° F., the offset value output 252 can be a value or amount that reflects, according to one of various conventions, the temperature difference of 15° F. In the implementations as discussed with respect to FIG. 3, the offset value output 252 can be a value or amount that corresponds to a valve position (e.g., a valve position of valve A 222 and/or valve B 224), and can be positive or negative. For example, a negative amount for the offset value output 252 can correspond to a closing of a valve and a positive amount for the offset value output 252 can correspond to an opening of a valve (or vice-versa). It should be appreciated that the output value output 252 can have a linear, exponential, or other mathematical relationship with the difference between temperature A 243 and temperature B 244, and that the input controller 250 can calculate the offset value output 252 according to various techniques or calculations.

Generally speaking, the model predictive control performed by the DMC-based output controller 251 is a multiple-input-single-output (MISO) control strategy in which the effects of changing each of a number of process inputs on each of a number of process outputs is measured and these measured responses are then used to create a model of the process. In some cases, though, a multiple-input-multiple-output (MIMO) control strategy may be employed. Whether MISO or MIMO, the model of the process is inverted mathematically and is then used to control the process output or outputs based on changes made to the process inputs. In some cases, the process model includes or is developed from a process output response curve for each of the process inputs and these curves may be created based on a series of, for example, pseudo-random step changes delivered to each of the process inputs. These response curves can be used to model the process in known manners. Model predictive control is known in the art and, as a result, the specifics thereof will not be described herein. However, model predictive control is described generally in Qin, S. Joe and Thomas A. Badgwell, "An Overview of Industrial Model Predictive Control Technology," *AIChE Conference,* 1996.

Moreover, the generation and use of advanced control routines such as model predictive control (MPC) control routines may be integrated into the configuration process for a controller for the steam generating boiler system. For example, Wojsznis et al., U.S. Pat. No. 6,445,963 entitled "Integrated Advanced Control Blocks in Process Control Systems," the disclosure of which is hereby expressly incorporated by reference herein, discloses a method of generating an advanced control block such as an advanced controller (e.g., an MPC controller or a neural network controller) using data collected from the process plant when configuring the process plant. More particularly, U.S. Pat. No. 6,445,963 discloses a configuration system that creates an advanced multiple-input-multiple-output control block within a process control system in a manner that is integrated with the creation of and downloading of other control blocks using a particular control paradigm, such as the Fieldbus paradigm. In this case, the advanced control block is initiated by creating a control block (such as the output controller 251) having desired inputs and outputs to be connected to process outputs and inputs, respectively, for controlling a process such as a process used in a steam generating boiler system. The control block includes a data collection routine and a waveform generator associated therewith and may have control logic that is untuned or otherwise undeveloped because this logic is missing tuning parameters, matrix coefficients or other control parameters necessary to be implemented. The control block is placed within the process control system with the defined inputs and outputs communicatively coupled within the control system in the manner that these inputs and outputs would be connected if the advanced control block was being used to control the process. Next, during a test procedure, the control block systematically upsets each of the process inputs via the control block outputs using waveforms generated by the waveform generator specifically designed for use in developing a process model. Then, via the control block inputs, the control block coordinates the collection of data pertaining to the response of each of the process outputs to each of the generated waveforms delivered to each of the process inputs. This data may, for example, be sent to a data historian to be stored. After sufficient data has been collected for each of the process input/output pairs, a process modeling procedure is run in which one or more process models are generated from the collected data using, for example, any known or desired model generation or determination routine. As part of this model generation or determination routine, a model parameter determination routine may develop the model parameters, e.g., matrix coefficients, dead time, gain, time constants, etc. needed by the control logic to be used to control the process. The model generation routine or the process model creation software may generate different types of models, including non-parametric models, such as finite impulse response (FIR) models, and parametric models, such as auto-regressive with external inputs (ARX) models. The control logic parameters and, if needed, the process model, are then downloaded to the control block to complete formation of the advanced control block so that the advanced control block, with the model parameters and/or the process model therein, can be used to control the process during run-time. When desired, the model stored in the control block may be re-determined, changed, or updated.

The output controller 251 can receive, as inputs, the output steam temperature 228 (or a control value associated with the output steam temperature 228) of the steam output from the final superheater section 206 as well as a setpoint 233 that may correspond to, for example, a desired temperature for the steam output from the final superheater section 206. In other cases, the setpoint 233 may correspond to other conditions that may influence the output steam temperature 228, such as a damper position of a damper within the boiler system, a position of a spray valve, an amount of spray, some other control, manipulated, or disturbance variable or combination thereof that is used to control or is associated with one or more sections of the boiler system. Generally, the setpoint 233 may correspond to a control variable or a manipulated variable of the boiler system, and may be typically set by a user or an operator.

The output controller 251 can compare the setpoint 233 to a measure of the actual temperature 228 of the steam currently being output from the final superheater section 206, to generate, determine, or calculate an input steam control signal 253. The input steam control signal 253 can be indicative of positions for valve A 222 and valve B 224 that, when combined with operation of the superheater section A 204, the superheater section B 205, and the final superheater section 206, aims to achieve the desired temperature (i.e., the setpoint 233) of the steam output from the final superheater section 206. Particularly, the input steam control signal 253 can correspond to valve settings (i.e., physical valve positions) for valve A 222 to control the first sprayer section 210 and for valve B 224 to control the second sprayer section 211. It should be appreciated that the output controller 251 can calculate the input steam control signal 253 according to various model-based techniques or calculations, as discussed herein.

The input steam control signal 253 can be provided to a balancer module 254 which can process the input steam control signal 253 to generate, determine, or calculate a temporary valve A control signal 255 and a desired valve B control signal 257. The balancer module 254 can include hardware and/or software components and can optionally be integrated as part of the output controller 251. In some implementations, the balancer module 254 can generate the temporary valve A control signal 255 and the desired valve B control signal 257 such that the control signals 255, 257 are equivalent (i.e., balanced), although it should be appreciated that the balancer module 254 can generate different values for the control signals 255, 257 based on physical configurations or settings of the valves 222, 224 or other components of the control system 300. The temporary valve A control signal 255 can correspond to a setting or position of valve A 222 to achieve a desired value for temperature A 243 of steam output from the superheater section A 204 and the valve B control signal 257 can drive valve B 224 to achieve a desired value for temperature B 244 of steam output from the superheater section B 205. The desired values for temperature A 243 and temperature B 244 are, of course, based on the setpoint 233 and the measure of the actual temperature 228. The balancer module 254 (or another module or component such as the output controller 251) can provide at least the valve B control signal 257 to valve B 224 to control the second sprayer component 211 and accordingly the temperature 244 of the steam output from superheater section B 205.

The control loop 330 further includes a summer module 256 configured to interface with the balancer module 254, the input controller 250, and optionally the output controller 251. The summer module 256 can include hardware and/or software components and can optionally be integrated as part of either the input controller 250 or the output controller 251. As illustrated in FIG. 3, the summer module 256 can receive, as inputs, the offset value output 252 output by the input controller 250 and the temporary valve A control signal 255 output by the balancer component 254. The summer module 256 can generate the desired valve A control signal 259 that is used to control valve A 222.

In particular, the summer module 256 can modify the temporary valve A control signal 255 by applying (e.g., adding, subtracting, or the like) the offset value output 252 to the temporary valve A control signal 255. For example, if the temporary valve A control signal 255 specifies an amount of 100 and the offset value output 252 is 5, the summer module 256 can add the offset value (5) to the temporary control signal (100) to determine the desired valve A control signal 259 of 105. It should be appreciated that other calculations, applications, determinations, or the like can be utilized to determine the desired valve A control signal 259. The summer module 256 (or another component such as the output controller 251) can provide at the desired valve A control signal 259 to valve A 222 to control the first sprayer section 210 and accordingly the temperature 243 of the steam output from superheater section A 204.

As discussed herein, the balancer module 254 can determine the valve B control signal 257 and provide the valve B control signal 257 to valve B 224 to control the second sprayer component 211, and the summer module 256 can determine the valve A control signal 259 and provide the valve A control signal 259 to valve A 222 to control the first sprayer component 210. The boiler system can experience improved temperature controls as measured by resulting temperature A 243, temperature B 244, and the output steam temperature 228. In operation, the adjustments of the first sprayer component 210 and the second sprayer component 210 results in the output steam temperature 228 that approaches and/or meets the setpoint 233. The use of the input controller 250, the output controller 251, the balancer module 254, and the summer module 256 in the control loop 330 reduces the frequency with which valve A and valve B are adjusted, thereby reducing overall temperature discrepancies and overall system use. Further, use of the control loop 330 helps increase the response time of the boiler system. Additionally, if there is a change in the setpoint 233, the control loop 330 determines a new valve B control signal 257 and a new valve A control signal 259 so that the boiler system efficiently and effectively achieves the desired output steam temperature 228 in a reduced amount of time.

Generally, as discussed herein, the control loop 330 of FIG. 3 is able to minimize complexity while still achieving efficient boiler system control. The output controller 251 can include a matrix or other model that includes values for the output controller 251 to use to determine, based on the output steam temperature 288 and the setpoint 233, a single input steam control signal. For example, if the output steam temperature 228 is 200° F. and the setpoint 233 is 220° F., the output controller 251 can determine (e.g., from using matrix values) that the temperature of the steam being input into the final superheater 206 needs to be 180° F. and accordingly that an input valve needs to be set at 50% to achieve the input steam temperature of 180° F. However, there are two valves, namely valve A 222 and valve B 224, that are needed to control the sprayer sections 210, 211. Adding data for an additional valve to the matrix or model of the output controller 251 would exponentially increase a number of entries and/or data needed in the matrix or model. By leveraging the input controller 250 that determines the offset value 252 and the summer module 256 that modifies the temporary valve A control signal 255 according to the offset value 252, the control loop 330 can account for both of the valve B control signal 257 and the valve A control signal 259 without having to over-complicate the programming of the output controller 251. Stated differently, the inclusion of the input controller 250 and the summer module 256 enables the output controller 251 to only have to determine a single valve control signal even though there are two valves to control.

Figure 4:
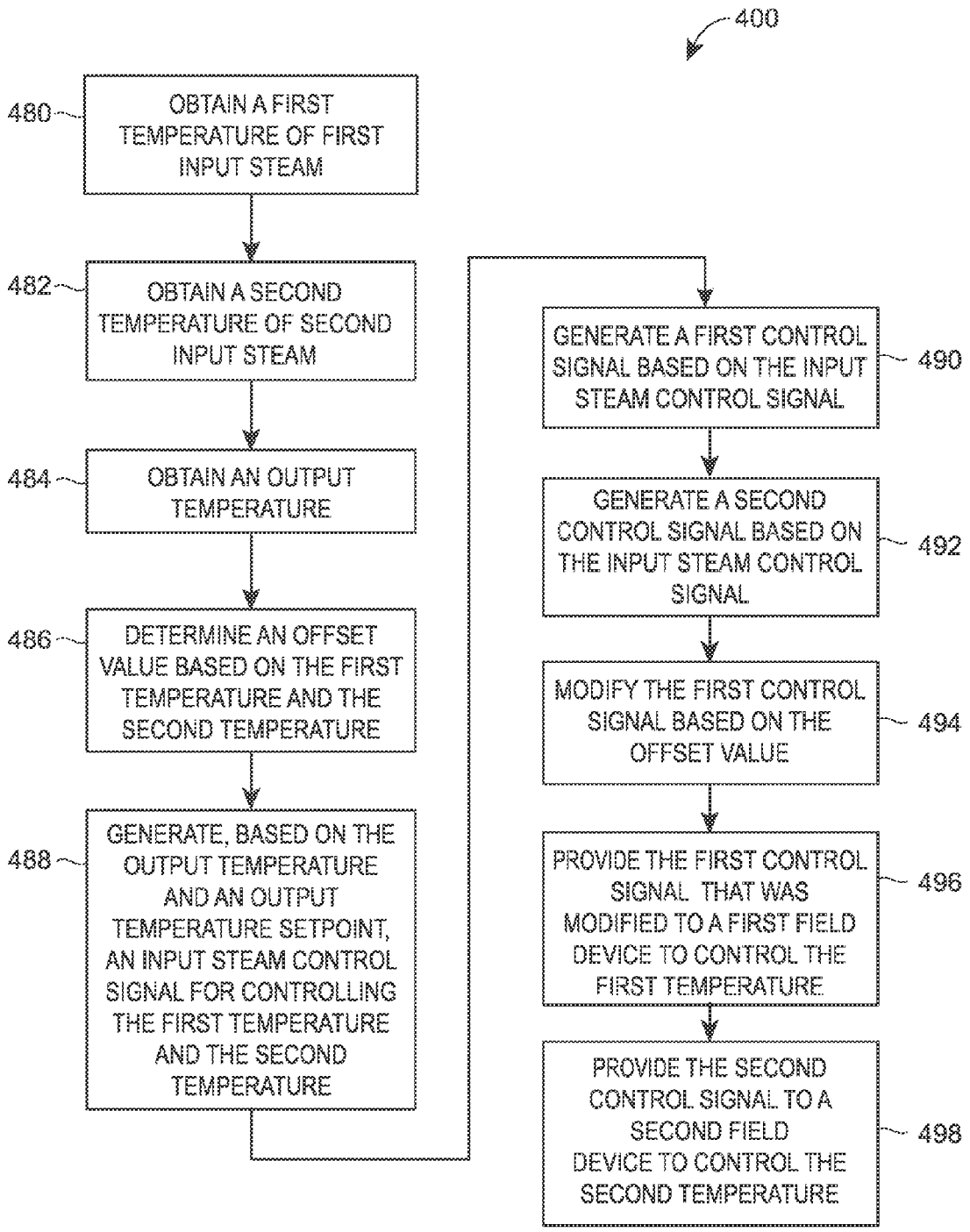
FIG. 4 illustrates an exemplary method of controlling a steam generating boiler system.

FIG. 4 illustrates an exemplary method 400 of controlling a steam generating boiler system, such as the steam generating boiler system 100 of FIG. 1. The method 400 may also operate in conjunction with the control system or control scheme 300 of FIG. 3. For example, the method 400 may be performed by one or more components of the control loop 330 or the controller 120. For clarity, the method 400 is described below with simultaneous referral to the boiler 100 of FIG. 1 and to the control system or scheme 300 of FIG. 3.

At block 480, a first temperature 243 (or a control value associated therewith) of first input steam may be obtained or received. The first input steam can correspond to steam output from the first superheater component 204 and used as an input to the final superheater component 206. At block 482, a second temperature 244 (or a control value associated therewith) of second input steam may be obtained or received. The second input steam can correspond to steam output from the second superheater component 205 and also used as an input to the final superheater component 206. At block 484, an output temperature 228 (or a control value associated therewith) may be obtained or received. The output temperature 228 can correspond to the temperature of steam output from the final superheater component 206.

At block 486, an offset value 252 based on the first temperature 243 and the second temperature 244 can be determined or calculated. In particular, the control loop 330 or the controller 120 can calculate the offset value 252 based on a difference between the first temperature 243 and the second temperature 244, wherein the offset value 252 can, in some cases, represent a difference in control signals that respectively control sprayers that respectively operate on steam having the first temperature 243 and the second temperature 244. It should be appreciated that other calculations for the offset value 252 may be utilized. At block 488, an input steam control signal 253 for controlling the first temperature 243 and the second temperature 244 can be generated, determined, or calculated based on the output temperature 228 and an output temperature setpoint 233. The input steam control signal 253 can be a value representing a first valve control signal 245 and a second valve control signal 246 that respectively control the first sprayer section 210 and the second sprayer section 211, and therefore the first temperature 243 and the second temperature 244.

At block 490, a first control signal 255 based on the input steam control signal 253 can be generated, determined, or calculated. At block 492, a second control signal 257 based on the input steam control signal 253 can be generated, determined, or calculated. In particular, a balancer module 254 can determine the first control signal 255 and the second control signal 257 based on the input steam control signal 253, whereby the first control signal 255 and the second control signal 257 can be similar or equal, or can otherwise specify the same or equal positions for the corresponding valve A 222 and valve B 224 that control respective sprayers 210, 211 for steam respectively output from the first superheater component 204 and the second superheater component 205.

At block 494, the first control signal 255 can be modified based on the offset value 252. In particular, the offset value 252 can be applied (e.g., added to, subtracted from, or the like) to the first control signal 255. At block 496, the first control signal that was modified 259 can be provided to a first field device 210 to control the first temperature 243. At block 498, the second control signal 257 can be provided to a second field device 211 to control the second temperature 244. Each of the first field device 210 and the second field device 211 is a valve for a sprayer component (e.g., valve A 222 and valve B 224), although it should be appreciated that other field devices for controlling the temperatures 243, 244 are envisioned.

The control schemes, systems and methods described herein are each applicable to steam generating systems that use other types of configurations for superheater sections than illustrated or described herein. Thus, while FIGS. 1-3 illustrate three superheater sections, the control scheme described herein may be used with boiler systems having more or less superheater sections, and which use any other type of configuration within each of the superheater sections.

Moreover, the control schemes, systems and methods described herein are not limited to controlling only an output steam temperature of a steam generating boiler system. Other dependent process variables of the steam generating boiler system may additionally or alternatively be controlled by any of the control schemes, systems and methods described herein. For example, the control schemes, systems and methods described herein are each applicable to controlling an amount of ammonia for nitrogen oxide reduction, drum levels, furnace pressure, throttle pressure, and other dependent process variables of the steam generating boiler system.

Although the forgoing text sets forth a detailed description of numerous different embodiments of the invention, it should be understood that the scope of the invention is defined by the words of the claims set forth at the end of this patent. The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention.

Thus, many modifications and variations may be made in the techniques and structures described and illustrated herein without departing from the spirit and scope of the present invention. Accordingly, it should be understood that the methods and apparatus described herein are illustrative only and are not limiting upon the scope of the invention.

What is claimed is:

1. A method of controlling a steam generating boiler system having two primary superheat sections forming a parallel connection to a final superheat section, comprising:

obtaining, via a first temperature sensor, a first temperature of first input steam of the steam generating boiler system;

obtaining, via a second temperature sensor, a second temperature of second input steam of the steam generating boiler system;

obtaining, via a third temperature sensor, an output temperature of output steam generated using the first input steam and the second input steam, the output steam for delivery to a turbine;

determining, via an input controller, an offset value in the form of a numerical quantity, the offset value being developed from a numerical, arithmetical difference between the first temperature and the second temperature;

generating, via an output controller and a balancer, based on the output temperature and an output temperature setpoint, a first control signal having a first control value for controlling the first temperature and a second control signal having a second control value for controlling the second temperature;

modifying, via a summer module, the first control signal by adding the offset value to the first control value or by subtracting the offset value from the first control value;

controlling the first temperature according to the first control signal that was modified; and controlling the second temperature according to the second control signal.

2. The method of claim 1, wherein controlling the first temperature comprises providing the first control signal that was modified to a first field device of the steam generating boiler system to control the first temperature; and wherein controlling the second temperature comprises providing the second control signal to a second field device of the steam generating boiler system to control the second temperature.

3. The method of claim 1, wherein determining the offset value comprises using a proportional-integral-derivative (PID) controller.

4. The method of claim 1, wherein determining the offset value comprises using a dynamic matrix controller (DMC).

5. The method of claim 1, wherein generating, based on the output temperature, the first control signal for controlling the first temperature and the second control signal for controlling the second temperature comprises:

generating, by a dynamic matrix controller (DMC), an input steam control signal based on the output temperature and the output temperature setpoint; and generating, based on the input steam control signal, the first control signal and the second control signal.

6. The method of claim 5, wherein generating the first control signal and the second control signal comprises splitting the input steam control signal such that the first control signal specifies an identical operational level for a first field device of the steam generating boiler system as the second control signal specifies for a second field device of the steam generating boiler system.

7. The method of claim 1, wherein obtaining 1) the first temperature of the first input steam and 2) the second temperature of the second input steam comprises obtaining 1) a first control value corresponding to the first temperature and 2) a second control value corresponding to the second temperature.

8. A controller system for use in a steam generating boiler system having a first input superheat section and a second input superheat section forming a parallel connection to an output superheat section, the controller system communicatively coupled to a first field device and to a second field device, and the controller system comprising:

a controller module including:

a first input to receive a first temperature of first input steam of the first input superheat section, second input to receive a second temperature of second input steam of the second input superheat section, a third input to receive an output temperature of output steam generated by the output superheat section using the first input steam and the second input steam, a fourth input to receive an output temperature setpoint, an input controller having processing logic configured to determine an offset value in the form of a numerical quantity, the offset value being developed from a numerical, arithmetical difference between the first temperature and the second temperature, a control routine configured to:

generate, via an output controller and a balancer, based on the output temperature and the output temperature setpoint, a first control signal having a first control value for controlling the first temperature and a second control signal having a second control value for controlling the second temperature, and modify, via a summer module, the first control signal by adding the offset value to the first control value or by subtracting the offset value from the first control value, a first output to provide the first control signal that was modified to the first field device to control the first temperature, and a second output to provide the second control signal to the second field device to control the second temperature.

9. The controller system of claim 8, wherein the processing logic is implemented as a proportional-integral-derivative (PID) controller.

10. The controller system of claim 8, wherein the processing logic is implemented as a dynamic matrix controller (DMC).

11. The controller system of claim 8, wherein the control routine is implemented as a dynamic matrix controller (DMC).

12. The controller system of claim 8, wherein the output controller comprises a dynamic matrix controller (DMC) that generates an input steam control signal based on the output temperature and the output temperature setpoint, and wherein the balancer module generates, based on the input steam control signal, the first control signal and the second control signal.

13. The controller system of claim 12, wherein the first control signal specifies the same operational level for the first field device as the second control signal specifies for the second field device.

14. The controller system of claim 8, wherein, to receive the first temperature of the first input steam, the first input receives a first control value corresponding to the first temperature, and wherein, to receive the second temperature of the second input steam, the second input receives a second control value corresponding to the second temperature.

15. The controller system of claim 8, wherein each of the first field device and the second field device is a valve for controlling a sprayer component.

16. A steam generating boiler system, comprising:
a boiler;
a first field device and a second field device; and
a controller communicatively coupled to the boiler, to the first field device, and to the second field device, the controller including a routine that:
obtains, via a first temperature sensor, a first temperature of first input steam to the boiler;
obtains, via a second temperature sensor, a second temperature of second input steam to the boiler, and
obtains, via a third temperature sensor, an output temperature of output steam generated by the boiler using the first input steam and the second input steam,
determines an offset value in the form of a numerical quantity, the offset value being developed from a numerical, arithmetical difference between the first temperature and the second temperature,
using a balancer module, generates, based on the output temperature and an output temperature setpoint, a first control signal having a first control value for controlling the first temperature and a second control signal having a second control value for controlling the second temperature,
modifies, via a summer module the first control signal by adding offset value to the first control value or by subtracting the offset value from the first control value,
provides the first control signal that was modified to the first field device to control the first temperature, and
provides the second control signal to the second field device to control the second temperature.

17. The steam generating boiler system of claim 16, wherein each of the first field device and the second field device is a valve for controlling a sprayer component.

18. The steam generating boiler system of claim 16, wherein the controller is implemented using a proportional-integral-derivative (PID) controller and a dynamic matrix controller (DMC).

19. The steam generating boiler system of claim 16, wherein the controller includes a dynamic matrix controller (DMC), and wherein the DMC generates an input steam control signal based on the output temperature and the output temperature setpoint.

20. The steam generating boiler system of claim 19, wherein the balancer module generates the first control signal and the second control signal based on the input steam control signal.

21. The steam generating boiler system of claim 20, wherein the first control signal specifies an identical operational level for the first field device as the second control signal specifies for the second field device.

22. The steam generating boiler system of claim 16, wherein, to obtain 1) the first temperature of the first input steam and 2) the second temperature of the second input steam, the controller obtains 1) a first control value corresponding to the first temperature and 2) a second control value corresponding to the second temperature.

23. A method of controlling a system having two parallelly-disposed flows connected to an output flow, comprising:
obtaining, via a first sensor, a first measurement associated with a first input flow of the system;
obtaining, via a second sensor, a second measurement associated with a second input flow of the system;
obtaining, via a third sensor, an output measurement of an output flow generated using the first input flow and the second input flow;
determining, via an input controller, an offset value in the form of a numerical quantity, the offset value being developed from a numerical, arithmetical difference between the first measurement and the second measurement;
generating, via an output controller and a balancer, based on the output measurement and an output measurement setpoint, a first control signal having a first control value for controlling the first measurement and a second control signal having a second control value for controlling the second measurement;
modifying, via a summer module the first control signal by adding the offset value to the first control value or by subtracting the numerical quantity of the offset value from the first control value;
controlling the first measurement according to the first control signal that was modified; and
controlling the second measurement according to the second control signal.

24. The method of claim 23, wherein controlling the first measurement comprises providing the first control signal that was modified to a first field device of the system to control the first measurement; and wherein controlling the second measurement comprises providing the second control signal to a second field device of the system to control the second measurement.

25. The method of claim 23, wherein determining the offset value comprises using a proportional-integral-derivative (PID) controller.

26. The method of claim 23, wherein determining the offset value comprises using a dynamic matrix controller (DMC).

27. The method of claim 23, wherein generating, based on the output measurement, the first control signal for controlling the first measurement and the second control signal for controlling the second measurement comprises:
generating, by a dynamic matrix controller (DMC), an input control signal based on the output measurement and the output measurement setpoint; and
generating, based on the input control signal, the first control signal and the second control signal.

28. The method of claim 27, wherein generating the first control signal and the second control signal comprises splitting the input control signal such that the first control signal specifies the same operational level for a first field device of the system as the second control signal specifies for a second field device of the steam generating boiler system.

29. The method of claim 23, wherein obtaining 1) the first measurement associated with the first input flow and 2) the second measurement associated with the second input flow comprises obtaining 1) one of a first temperature or a first flow rate and 2) one of a second temperature or a second flow rate.

30. The method of claim 23, wherein obtaining 1) the first measurement associated with the first input flow and 2) the second measurement associated with the second input flow comprises obtaining 1) a first control value corresponding to the first measurement and 2) a second control value corresponding to the second measurement.

* * * * *